US007695090B2

(12) United States Patent
Kawamura et al.

(10) Patent No.: US 7,695,090 B2
(45) Date of Patent: Apr. 13, 2010

(54) INK JET PRINTING APPARATUS, METHOD FOR DETERMINING PRINT MEDIUM, AND METHOD FOR DETERMINING INK EJECTION AMOUNT

(75) Inventors: Hidetaka Kawamura, Yokohama (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 424 days.

(21) Appl. No.: 11/680,223

(22) Filed: Feb. 28, 2007

(65) Prior Publication Data

US 2007/0206039 A1 Sep. 6, 2007

(30) Foreign Application Priority Data

Mar. 6, 2006 (JP) ..... 2006-059977

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 5,274,395 A 12/1993 Mizoguchi et al.
5,925,889 A 7/1999 Guillory et al.
6,006,668 A 12/1999 Rehmann
6,079,807 A 6/2000 Lindstrom et al.
6,644,764 B2 * 11/2003 Stephens, Jr. ..... 347/3
6,733,102 B2 * 5/2004 Hosono ..... 347/14
2006/0071990 A1 * 4/2006 Hirakawa ..... 347/95

FOREIGN PATENT DOCUMENTS

JP 11-216938 8/1999
JP 11-235856 8/1999

* cited by examiner

*Primary Examiner*—Julian D Huffman
(74) *Attorney, Agent, or Firm*—Fitzpatrick, Cella, Harper & Scinto

(57) ABSTRACT

An ink jet printing apparatus can prevent erroneous selection of the print mode, which may degrade the image quality, without imposing any special burden on the user. Specifically, a dot is formed on a print medium to sense the ability of the print medium to absorb printing ink. The ink jet printing apparatus has a reading device for reading the dot and a print mode selecting device for setting the optimum print mode from a plurality of print modes according to the shape of the dot.

18 Claims, 12 Drawing Sheets

INK JET PRINTING APPARATUS, METHOD FOR DETERMINING PRINT MEDIUM, AND METHOD FOR DETERMINING INK EJECTION AMOUNT

BACKGROUND OF THE INVENTION

1. Field of the Invention

The present invention relates to ink jet printing apparatuses that perform printing on print media in accordance with print data using an ink jet print head that ejects a colored liquid (ink) in droplet form. In particular, the present invention relates to ink jet printing apparatuses that automatically determine the optimum print mode on the basis of the type of paper or ink jet printing apparatuses that automatically determine the optimum ink ejection amount. The present invention also relates to methods for determining print media using any of these ink jet printing apparatuses and methods for determining ink ejection amount.

2. Description of the Related Art

The ink jet printing scheme forms images by ejecting a monochromatic ink or a plurality of color inks for color printing onto print media (paper, clothes, OHP paper, printed circuit boards, or the like). An ink jet printing apparatus employing this printing scheme generally comprises a carriage on which a print head and an ink tank are mounted, means for reciprocating the carriage, a conveying section that conveys print media, and a control section that controls these components.

Such an ink jet printing apparatus ejects ink droplets through a plurality of ejection ports (nozzles) while serially scanning the print head in a direction (main scanning direction) crossing (for example, substantially orthogonal to) a direction (sub-scanning direction) in which print media are conveyed. On the other hand, each print medium is intermittently conveyed in increments of a predetermined amount to allow the ink jet printing apparatus to print the print medium in accordance with the print data.

The ink jet printing scheme ejects ink directly onto a print medium in response to a print signal and is thus widely used as a simple, inexpensive printing scheme. The ink jet printing apparatus is not only used for a monochromatic ink but can also be adapted for full colors by providing a plurality of print heads for the respective color inks. Some full color type ink jet printing apparatuses comprise four types of print head for four colors, that is, three primary colors including yellow (Y), magenta (M), and cyan (C) as well as black (B), and further comprise ink tanks. Some full color type ink jet printing apparatuses comprise six types of print head for six colors, that is, the above four colors plus pale magenta (PM) and pale cyan (PC).

The conventional ink jet printing apparatus is disadvantageous in that ink attached to a print medium to form characters or images may dissolve into water to cause the printed characters to bleed. This has led to a demand for a technique for printing waterproof images that prevent the characters from being degraded. One such technique is a method of, before or after ink ejection, ejecting a treatment liquid to an ejection position for the ink on a print sheet in order to improve printability. With this method, for example, before ink ejection, a treatment liquid is ejected to the ejection position for the ink, at first. Subsequently, printing ink is ejected to the position to which the treatment liquid has been ejected. The two droplets mix on the print sheet to make it difficult to dissolve the ink into water. The treatment liquid has, for example, the property of being transparent and of fixing the ink on the print sheet.

On the other hand, some ink jet printing apparatuses can print a large number of print media such as ordinary paper, matte paper, and glossy paper. Some of these ink jet printing apparatuses execute print modes corresponding to the different types of print medium in order to perform printing operations appropriately corresponding to the types of print media. For example, some types of print medium require a relatively large amount of ink to achieve a high optical density, and the amount of ink required varies depending on the type of the print medium. Further, the time required to fix ink on the print medium varies depending on the type of the print medium. Thus, the ink jet printing apparatus can achieve a high image grade for each type of print media by performing printing in the print mode corresponding to the type of print media. Some of these ink jet printing apparatuses require users to select the type of print media for printing.

However, many users fail to recognize the necessity to select the print mode depending on the type of print media. The user simply depresses a "print" button to start a printing process. In this case, the printing apparatus executes printing in a print mode normally set by default (initial setting) or an already set print mode. If the executed print mode fails to correspond to the print media in an installed cassette, it causes problems such as the resulting image quality may disadvantageously be degraded. For example, the optimum print mode varies among ordinary paper, matte paper, and glossy paper.

The matte paper has high ink absorbing ability. Therefore, the matte paper causes insufficient optical density of pixels, resulting in a bluffed image, unless a larger amount of ink is ejected to the matte paper than to the ordinary paper. Further, owing to its absorptivity, the glossy paper may require a much larger amount of ink for bright colors. Moreover, some types of glossy paper require a long time for the ink to be absorbed by and fixed on the print medium. Therefore, in case of printing to glossy paper, it requires a longer time for the ink to be fixed on the print medium than case of printing to ordinary paper.

With the configuration in which the user selects the print mode, when, for example, the print mode for the glossy paper set in the printing apparatus during the last printing process remains set, the user may simply depress the print button without selecting the print mode again. In this case, if sheets of ordinary paper are stacked in a tray of the printing apparatus, the apparatus prints the ordinary paper in the print mode for the glossy paper. This causes a large amount of ink to be ejected, resulting in an increase in printing time as well as excessively dark and damp images. Further, in pixels in which different colors are adjacent to each other, the corresponding inks may run and mix to markedly degrade the image quality. Moreover, ink having failed to be absorbed by an ink receiving layer of the print medium may adhere to and thus contaminate the printing apparatus and adhere to the back surface the succeeding printed print medium on a discharge tray to also degrade the quality of the image on this print medium.

As described above, one of major causes of the degraded image quality is the failure to properly select the print mode according to the ink absorbing characteristic of print media.

In recent years, users' diversified demands have made many types of print medium with various characteristics commercially available from ink jet printing apparatus manufacturers and other venders. Thus, to obtain print matter with desired image quality, the user needs to select the optimum print mode (print medium type). However, the large number of print medium types has made it difficult for the user to select the optimum print mode. Consequently, the ink jet printing apparatus desirably senses the type of the print media stacked (or the ink absorptivity of the print media) to select the appropriate print mode, eliminating the need for the user to select the print mode.

In this regard, some ink jet printing apparatuses have a paper type sensor to recognize and check the material characteristics of print media against already memorized paper types to determine the type of the print media to automatically select the optimum print mode. For example, an ink jet printing apparatus described in Japanese Patent Laid-Open No. 11-235856 comprises a paper type sensor composed of a through-beam optical interrupter sensor. The through-beam optical interrupter sensor determines the type of the print media to in turn determine whether the print media are transparent sheets or opaque ordinary paper. If the print media are transparent sheets, the type is determined to be transparent sheets. Then, the optimum print mode is automatically selected depending on the detected print media.

An ink jet printing apparatus described in Japanese Patent Laid-Open No. 11-216938 exposes the print media to light to detect the gloss or color of the print media on the basis of reflected light to automatically correspondingly select a print medium type.

An ink jet printing apparatus described in U.S. Pat. No. 6,006,688 exposes the print media to light to measure the intensity of reflected light to determine the type of the print media to automatically select the optimum print mode.

The methods described in Japanese Patent Laid-Open Nos. 11-235836 and 11-216938 and U.S. Pat. No. 6,006,688 all simply determine the type of the print media on the basis of their optical properties. None of these methods determine the type of the print media on the basis of their ink absorptivity. Thus, if the print media offer similar optical properties but different ink absorption characteristics, the accuracy of determination of the print media is limited. As a result, the optimum print mode may not be selected.

SUMMARY OF THE INVENTION

The object of the present invention is to provide an ink jet printing apparatus that can prevent the erroneous selection of a print mode, which may lead to image degradation, without imposing any special burden on a user.

In a first aspect of the present invention, there is provided an ink jet printing apparatus provided with an ink jet print head that ejects printing ink to a print medium for performing printing, and which sets a plurality of print modes for plural types of the print medium, said apparatus comprising: dot forming means for forming a dot by applying a liquid droplet to the print medium; reading means for reading said dot formed according to an ability of the print medium to absorb the printing ink; and print mode setting means for setting a print mode according to a signal read by said reading means.

In a second aspect of the present invention, there is provided an ink jet printing apparatus having an ink jet print head that ejects printing ink to a print medium for printing, the apparatus comprising: dot forming means for forming a dot by applying a liquid droplet to the print medium; reading means for reading said dot formed on the basis of an ability of the print medium to absorb the printing ink; and ink ejection amount determining means for determining an ink ejection amount of the printing ink, the ink ejection amount being suitable for the print medium on the basis of a signal read by said reading means.

In a third aspect of the present invention, there is a method for determining a print medium in an ink jet printing apparatus that ejects printing ink to the print medium, the method comprising: a dot forming step of forming a dot by applying a liquid droplet to the print medium; a dot reading step of reading said dot formed on the basis of an ability of the print medium to absorb the printing ink; and a print medium determining step of determining the print medium on the basis of a signal read in said dot reading step.

In a fourth aspect of the present invention, there is a method for determining an ink ejection amount of an ink jet printing apparatus that ejects printing ink to the print medium, the method comprising: a dot forming step of forming a dot by applying a liquid droplet to the print medium; a dot reading step of reading said dot formed on the basis of an ability of the print medium to absorb the printing ink; and an ink ejection amount determining step of determining an ink ejection amount of the printing ink, the ink ejection amount being suitable for the print medium on the basis of the dot read in said dot reading step.

In a fifth aspect of the present invention, there is an ink jet printing apparatus using a print head that ejects a liquid to form an image on a print medium, the apparatus comprising: ejecting means for ejecting the liquid to the print medium; irradiating means for irradiating the liquid ejected by said ejecting means with the invisible region light; light receiving means for receiving reflected light corresponding to applied light reflected by said liquid or light emitted by said liquid in response to the applied light; and setting means for setting a print mode for formation of an image on the print medium on the basis of the quantity of light received by said light receiving means.

Droplets are ejected onto the print medium. The print mode is the determined on the basis of the degree to which the droplets are absorbed by the print medium.

Further features of the present invention will become apparent from the following description of exemplary embodiments (with reference to the attached drawings).

DESCRIPTION OF THE EMBODIMENTS

Embodiments of the present invention will be described below with reference to the drawings.

First Embodiment

Figure 1:
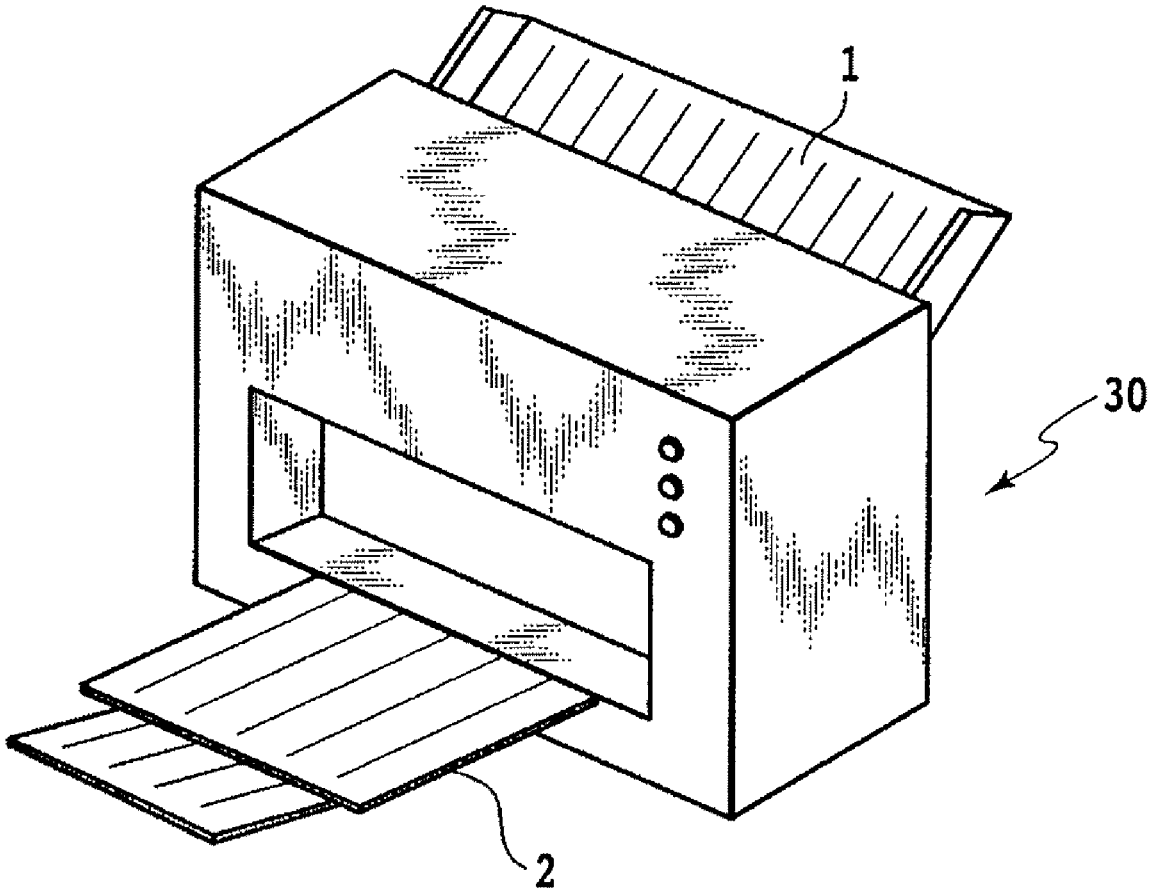
FIG. 1 is a perspective view showing an example of an ink jet printing apparatus in accordance with the present invention.
Figure 2:
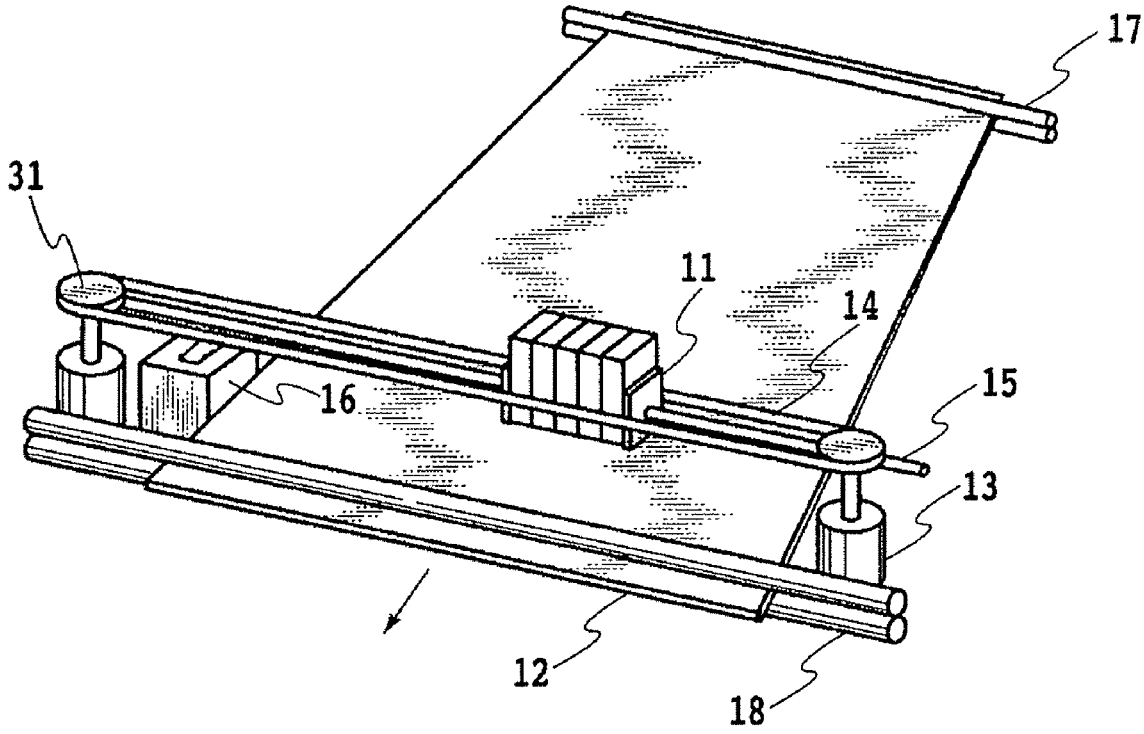
FIG. 2 is a perspective view showing an essential part of the ink jet printing apparatus shown in FIG. 1.

First, with reference to FIGS. 1 to 3, description will be given of an ink jet printing apparatus in accordance with a first embodiment of the present invention. FIG. 1 is a perspective view of an ink jet printing apparatus 30 in accordance with the present embodiment. FIG. 2 is a schematic perspective diagram of main arrangements in the ink jet printing apparatus 30.

The ink jet printing apparatus 30 comprises a sheet feeding tray 1 and a sheet discharging tray 2. Print media 12 are set (stacked) in the sheet feeding tray 1. Each print medium 12 is printed in the ink jet printing apparatus 30 and discharged to the sheet discharging tray 2. The print medium is conveyed from the sheet feeding tray 1 to the sheet discharging tray 2 by means of conveying rollers 17 and 18 in the ink jet printing apparatus. The conveying rollers 17 and 18 are rotationally driven by a conveying motor (not shown). The conveying rollers 17 and 18 are located in the ink jet printing apparatus 30 on a downstream side and an upstream side, respectively, of a direction in which the print medium 12 is conveyed; each of the conveying rollers 17 and 18 comprises two rollers that sandwich the front and back surfaces of the print medium 12 between themselves.

A carriage 11 has a carriage driving motor 13 so as to scan a print area containing the print medium 12 in a reciprocatory manner. Rotation of the carriage driving motor 13 transmits a driving force to a carriage driving belt 14 via a pulley 31 to move the carriage 11, connected to a carriage driving belt 14. The pulley 31 is located in the vicinity of each of the opposite ends of the printing apparatus. The carriage driving motor 13 is connected to one of the pulleys 31. A carriage driving belt 14 and a carriage driving rail 15 are extended between the pulleys 31. The carriage driving rail 15 penetrates and slidably supports the carriage 11, to which the carriage driving belt 14 is connected. Rotation of the pulleys 31 drives the carriage driving belt 14 to allow the carriage 11 to correspondingly reciprocate in a direction substantially orthogonal to the direction of conveyance of the print medium 12. The carriage driving motor 13 and the above conveying motor have their operations controlled by a control circuit (not shown). An ink jet print head 19 is also mounted on the carriage 11 to eject ink droplets.

An ejection recovery section 16 is located on one side of moving path of the carriage 11 to recover ejecting performance so as to allow ink droplets to be properly ejected through nozzles 20 in the ink jet print head 19. The ejection recovery section 16 comprises an ejection recovery pump (not shown). The ejection recovery section 16 performs a preliminary ejection operation, a suction recovery operation, a wiping operation, and the like.

Figure 3:
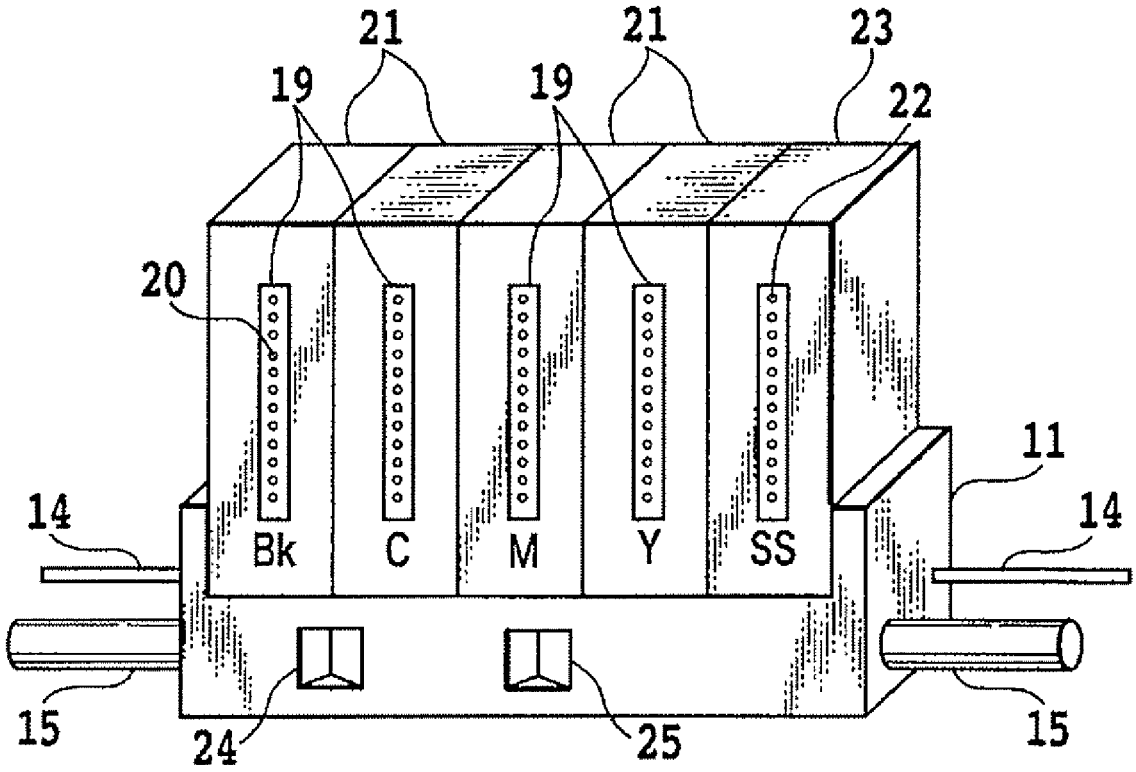
FIG. 3 is a perspective view showing a carriage used in the example shown in FIG. 2.

FIG. 3 is an enlarged view of the carriage in FIG. 2 as viewed from the print medium. Four ink tanks 21 and one treatment liquid tank 23 are mounted on the carriage 11. Each of the ink tanks 21 has the ink jet print head 19. The ink jet print head 19 utilizes thermal energy to generate bubbles in ink to eject the ink (a liquid containing printing ink or a treatment liquid) on the basis of the bubble generation. The four ink jet print heads 19 and the four ink tanks 21 correspond to the respective color inks, black (B), yellow (Y), cyan (C), and magenta (M). A plurality of nozzles 20 are arranged in each of the ink jet print heads 19 to form a nozzle line. FIG. 3 shows only one nozzle line, but the ink jet print head 19 may comprise a plurality of nozzle lines per ink. To print the print medium 12 with ink, the ink stored in any of the ink tanks 21 is supplied to the ink jet print head 19. Ink droplets are then ejected through the ink jet nozzles 20. The ink jet print head 19 is supported on the carriage 11 with the ink jet nozzles 20 facing downward (opposite the print medium). The ink jet print head 19 is located so that during printing, ink droplets ejected through the ink jet nozzles 20 impact the print medium 12 to form an image. In FIG. 3, the carriage 11 constitutes an ink jet cartridge in which the ink tanks 21 and ink jet print head 19 are integrated together. The present invention is established even when the ink tanks 21 and ink jet print head 19 are detachable.

In FIG. 3, a treatment liquid tank 23 is located adjacent to the four ink jet print heads 19 and four ink tanks 21 to store a treatment liquid described below. The treatment liquid tank 23 comprises treatment liquid nozzles 22 through which the treatment liquid is ejected to the print medium 12. To sense the type of the print medium 12 before ink ejection, the treatment liquid is ejected to the print medium through the treatment liquid nozzles 22.

When printing is not executed over a long period, that is, when the ink inside the ink tank 21 or the treatment liquid inside the treatment liquid tank 23 is not used over a long period, ink evaporates through the nozzles 20 and 22 and increases the viscosity of the ink in the nozzles 20. The ink thus accumulatively sticks to the nozzles 20 to clog the ejection ports. The clogged ejection ports may prevent ink droplets from being ejected through the nozzles or cause the ink droplets to impact the incorrect position. This may degrade the image quality. Further, continuous printing, that is, the continuous ejection of ink droplets through the ejection ports, may attach ink or dirt to an ejection port surface of the ink jet print head 19 on which the ejection ports are formed. This may cause ink droplets ejected through the ejection ports to impact the incorrect position (this phenomenon is called biasing).

To avoid the clogging of the ejection ports and the incorrect impact position of ink droplets, a recovery operation for maintaining the proper ejection through the ejection ports is performed when printing is not executed for a predetermined time or is continuously executed. Specifically, the carriage driving motor 13 drivingly moves the carriage 11 to move the ink jet print heads 19 and treatment liquid head 22 onto the ejection recovery section 16. With the ejection recovery section 16 (cap) abutting on the nozzles 20 at the bottoms of the ink jet print heads 19 and treatment liquid head 22, an ejection recovery pump is driven. This generates negative pressure to allow the ink and treatment liquid to be sucked from the ink jet print heads 19 and treatment liquid head 22. This enables the ink and treatment liquid with their viscosity increased to be removed from the nozzles 20 to recover the ejecting performance of the ink jet print heads 19 and treatment liquid head 22.

Figure 4A:
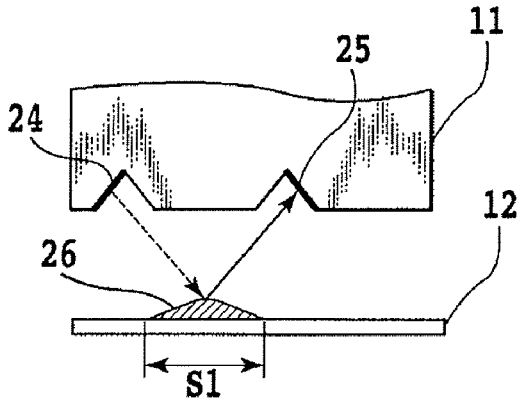
FIGS. 4A and 4B are diagrams illustrating a process of reading a dot using reading means provided in the carriage shown in FIG. 3 in accordance with a first embodiment.
Figure 4B:
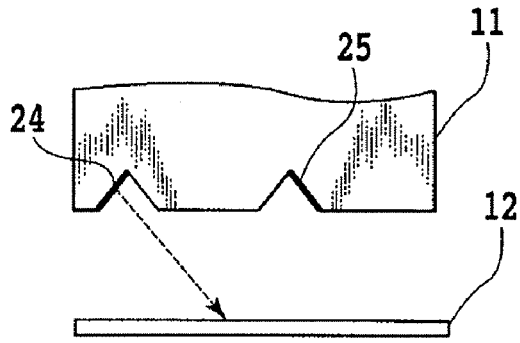

FIGS. 4A and 4B are schematic diagram illustrating an arrangement for determining the type of the print medium using an optical sensor comprising a UV emitting LED and a photodiode.

As shown in FIGS. 4A and 4B, the carriage 11 has a UV emitting LED 24 constituting light emitting means and a photodiode 25 constituting light receiving means. The print medium 12 is located below the carriage 11.

To sense the type of the print medium 12, first, the treatment liquid is ejected from the treatment liquid head 22. The ejected treatment liquid impacts the print medium 12. A dot 26 formed of the treatment liquid is placed on the print medium 12. If the print medium 12 is formed of a material that does not completely absorb the treatment liquid, the treatment liquid remains on the print medium 12. The dot 26 subsequently remains formed on the print medium 12 as shown in FIG. 4A. If the print medium 12 is formed of a material that completely absorbs the treatment liquid, the treatment liquid completely permeates the print medium 12. Consequently, the dot 26 is not formed on the print medium 12 as shown in FIG. 4B.

The activated UV emitting LED 24 emits ultraviolet radiation (ultraviolet light having a wavelength of at most 400 nm) corresponding to invisible region light. Here, the treatment liquid for the present embodiment contains a luminescent substance that emits light when irradiated with an ultraviolet light ray. As shown in FIG. 4A, when the print medium 12 has a low absorptivity, the dot 26 remains formed on the print medium 12. Accordingly, the ultraviolet ray emitted by the UV emitting LED 24 impinges on the dot 26 formed on the print medium. The dot of the treatment liquid emits light that can be sensed by the photodiode 25. Part of the light emitted by the dot 26 is received and detected by the photodiode 25. Further, as shown in FIG. 4B, when the print medium 12 has a high absorptivity, the droplet impacting the print medium 12 is absorbed by the print medium 12. Consequently, even when the ultraviolet ray emitted by the UV emitting LED 24 impinges on the dot 26 absorbed by the print medium 12, the dot 26 of the treatment liquid does not emit (or if it emits light at all, the light is faint). Therefore, the photodiode 25 does not detect any light emitted by the print medium 12. In the above description, the dot 26 emits light when irradiated with ultraviolet radiation emitted by the UV emitting LED 24. However, in another possible aspect, the dot 26 does not emit light, and the photodiode 25 may detect reflection from the dot 26 irradiated with light.

When the treatment liquid is ejected onto the print medium 12 to form a dot 26, the dot 26 has a size corresponding to the ink absorptivity of the print medium. That is, the large amount of treatment liquid permeates the print medium 12, if the ink absorptivity of the print medium 12 is large. This reduces the size (area) W1 of an exposed area S1 (which remains on the print medium 12 without being absorbed by the print medium 12) on the print medium 12, in case of the large ink absorptivity of the print medium 12. In contrast, the size W1 of exposed area S1 of the dot 26 on the print medium 12 is large, if the amount of the ink absorptivity of the print medium 12 is small.

Figure 6:
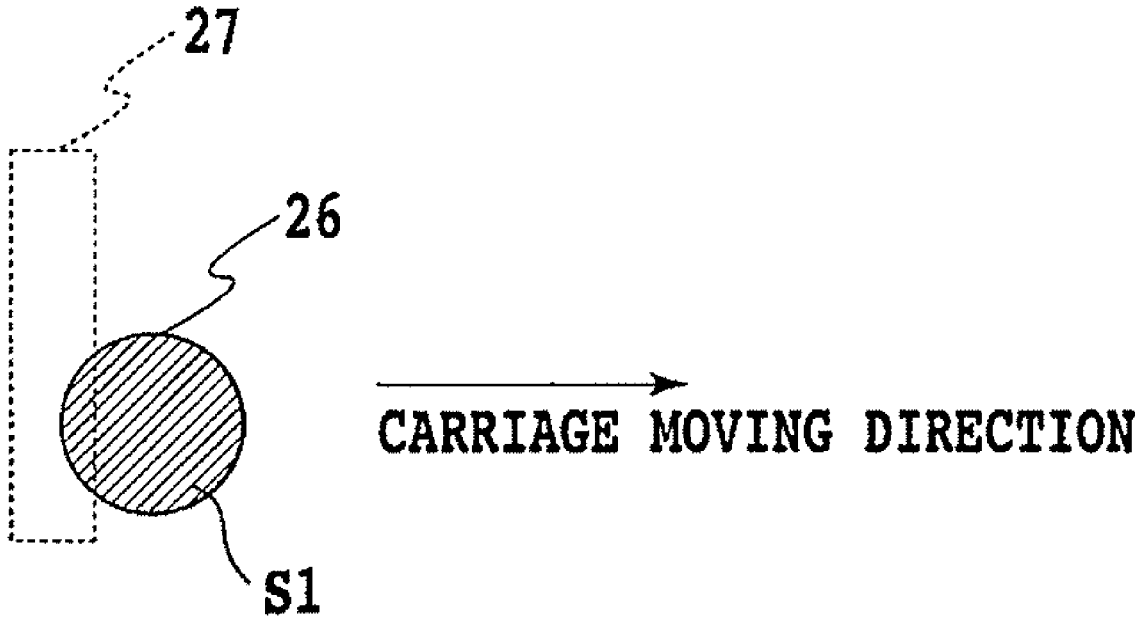
FIG. 6 is a plan view showing the relationship between a dot and an area sensed by a photodiode in accordance with the first embodiment.

FIG. 6 is a diagram illustrating sensing of the dot 26 executed by the photodiode 25. FIG. 6 is a schematic diagram illustrating the relationship between the dot 26 and the area 27 of sensing executed by the photodiode 25 which relationship is observed when the photodiode 25 receives part of light emitted by the dot 26 irradiated with ultraviolet radiation. The photodiode 25 has a cylindrical lens (not shown) on the print medium side of the light receiving section. Thus, the rectangular sensing area 27 is formed on the print medium 12; the sensing area 27 is wider in a direction perpendicular to the direction of movement of the carriage shown by an arrow in the figure. As shown in FIG. 6, when fixed, the photodiode 25 with the rectangular sensing area 27 cannot detect the entire dot 26. Thus, to detect the dot 26, which emits light when irradiated with ultraviolet light, the carriage 11 is scanned in the main scanning direction to detect the entire dot 26. Since the optical sensor is located on the carriage 11, the entire dot 26 can be detected by moving the carriage even though the sensing area 27 is smaller than the area of the dot 26.

Figure 7:
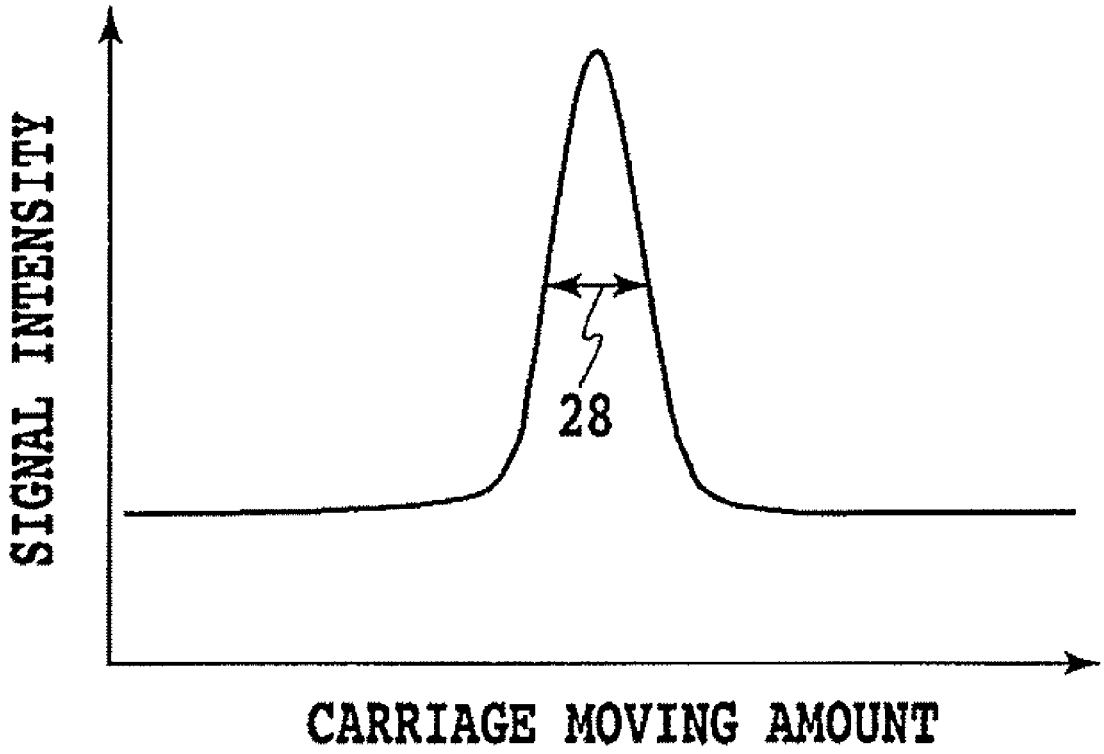
FIG. 7 is a graph of signal data output by the photodiode in accordance with the first embodiment of the present invention.

FIG. 7 is a graph of data indicating the intensity of data output by the photodiode 25. The UV emitting LED 24 emits ultraviolet radiation to the print medium 12, and the dot 26 on the print medium 12 emits light. The emitted light is received within the sensing area 27 of the photodiode 25, serving as a light receiving section. Then, information indicating the intensity of light is output as a data signal. The intensity of light received by the photodiode 25 varies depending on the area W of exposed area of the dot 26 on the print medium 12, shown in FIG. 4A. The intensity of light increases, if the size W1 of exposed area S1 of the dot 26 on the print medium 12 increases. And the intensity of light decreases, if the size W1 of exposed area S1 of the dot 26 on the print medium 12 decreases. On the basis of the data in the signal indicating to the quantity of light received, an optimum print mode determining circuit calculates the half-value width 28 of a signal peak. Here, the half-value width refers to the lateral width of the signal at a position corresponding to the half of height of peak of the signal intensity.

Figure 5:
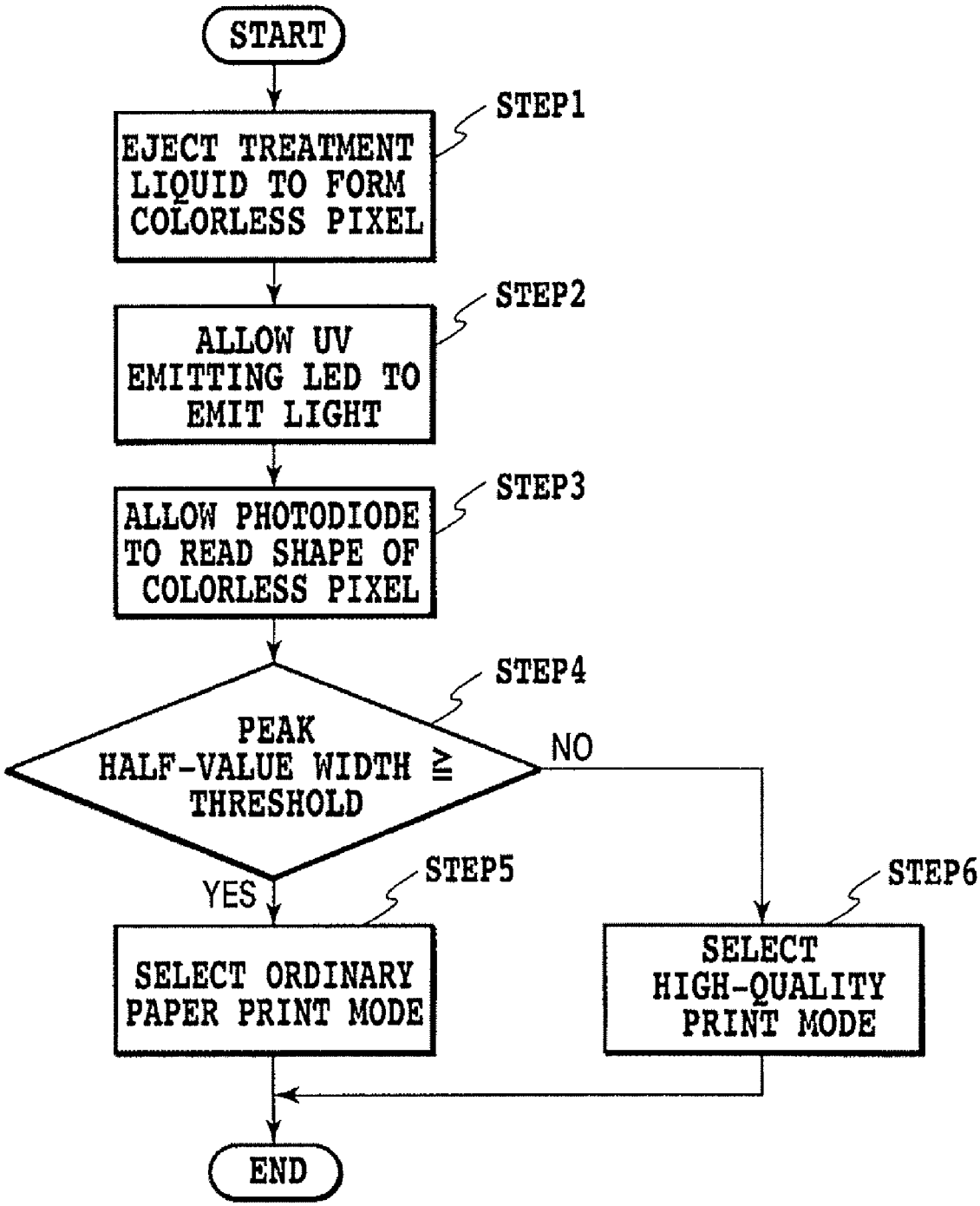
FIG. 5 is a flowchart showing a method for determining a print mode in accordance with the first embodiment of the present invention.

Now, with reference to FIG. 5, description will be given of a method for determining the print mode in accordance with the present invention. FIG. 5 is a flowchart illustrating the UV emitting LED 24 and photodiode 25 as well as an optimum print mode determining process operation for controlling the print mode.

The ink jet printing apparatus receives a print JOB signal indicating the start of a printing operation, from a host apparatus connected to the printing apparatus. The control section in the printing apparatus starts an optimum print mode determining process. Plurality of print modes corresponding to the respective print media are already set in the printing apparatus. In step 1, the printing apparatus performs the operations of scanning the carriage 11 and feeding and conveying a print medium so that the carriage 11 lies opposite the print medium 12. Then, the print head 22 ejects the treatment liquid. For example, the print head 22 ejects the treatment liquid to the vicinity of front end (leading end) of the print medium 12 to form a dot 26. The adverse effect of the treatment liquid on an image to be actually printed can be reduced by allowing the print head 22 to eject the treatment liquid to the vicinity of the leading end of the print medium 12.

In step 2, the carriage 11 or print medium 12 is moved by a prescribed amount to allow the optical sensor to detect the dot of the treatment liquid ejected in step 1. The UV emitting LED 24 is then activated to irradiate the area including the dot 26 formed in step 1, with ultraviolet light. If the treatment liquid remains (exposed) on the surface of the print medium 12 without being absorbed by the ink receiving layer of the print medium 12, the ultraviolet ray impinges on the dot 26 of the treatment liquid, which then emits light and develops a color.

In step 3, the light receiving section performs a sensing operation with the carriage 11 scanned. The photodiode 25 receives part of light emitted by the part S1 of the exposed dot 26 on the print medium 12. The control section converts the light emitted in the sensing area 27 into data to read the intensity of the light. In step 3, the control section reads the intensity of the light emitted in the sensing area 27; the intensity corresponds to the surface area W1 of the exposed area S1 of the dot 26 on the print medium 12.

In step 4, on the basis of quantity of light emitted by the treatment liquid which quantity has been detected in step S3, that is, the quantity of light received by the photodiode 25, the half-value width of the peak is calculated. The printing apparatus then compares the half-value width of the peak with a prestored threshold. If the half-value width, varying depending on the area W1 of the exposed part S1 of the dot 26 on the print medium, is equal to or greater than the threshold, the print medium is determined to be of a type having a relatively low absorptivity. The print medium determining step is executed as described above; the print medium type is determined on the basis of the signal read in step 3. Then, in step 5, the print mode of ordinary paper, which requires a less amount of ink ejected, is selected. Then the process in step 5 is finished. When the half-value width is smaller than the threshold, the print medium is determined to have a high ink absorptivity. Then, in step 6, a high grade print mode requiring a large amount of ink ejected is selected. Then the process in step 6 is finished. The ink ejection amount is adjusted on the basis of duty ratio, density ratio, the number of injections into a unit pixel, or the number of printing scans.

Once the type of the print medium 12 is sensed as described above, a printing operation is performed printing in the print mode corresponding to the type of the print medium 12 selected on the basis of the sensing result.

Once the process in FIG. 5 determines the print mode, the leading end of the print medium 12 is conveyed by a predetermined amount in the direction opposite to that of conveyance. The ink jet print head 19 is thus placed at the front or leading end of the print medium 12. Then, ink is ejected with the carriage 11 moved in the main scanning direction to perform a printing operation for one printing scan of vicinity of the front or leading end of the print medium 12. An image of a prescribed print width is formed. At this time, as described below, if the treatment liquid makes the ink insoluble to water, the ink jet print head 19 may eject the treatment liquid together with the ink. Once the printing operation for one printing scan is finished, the print medium 12 is conveyed by a prescribed amount (for example, the amount equal to the print width). Printing ink is again ejected onto the print medium 12 with the carriage moved in the main scanning direction. This is repeated to print the entire print medium.

The present embodiment allows the ink jet print head 19 to eject the treatment liquid onto the print medium 12 and determines the print mode on the basis of the degree to which the treatment liquid is absorbed by the print medium 12. This eliminates the need for the user to select the type of the print medium 12. The user can perform printing a high-quality image on the print medium 12 without selecting the type of the print medium 12. Specifically, the present invention applies the treatment liquid to the print medium 12 to create a dot 26 and measures the ink absorptivity of the print medium on the basis of the size W1 of exposed area S1 of the dot 26 on the print medium 12. The optimum print mode is thus selected according to the ink absorptivity. Printing is then executed in the optimum print mode corresponding to the selected type of the print medium 12. This makes it possible to prevent the erroneous selection of the print mode, which may degrade the image quality, without imposing any special burden on the user. Further, if the characteristics of the treatment liquid material are similar to those of the ink material, the print modes may be preset taking into account bleeding that may result from ink ejection during printing.

In the above description, the above process is executed by the printing apparatus. However, the process may be executed by the host apparatus (personal computer or the like) connected to the printing apparatus.

In the present embodiment, the printing apparatus selects the type of the print medium on the basis of the degree to which the treatment liquid is absorbed. However, the printing apparatus (or host apparatus) may display the optimum print medium type on the display screen so that the user can set the print mode corresponding to the print medium type according to the displayed print medium type. Alternatively, the user may set print media of the displayed type in the printing apparatus.

The process of selecting the print mode as shown in FIG. 5 selects one of the ordinary paper print mode and the high-quality print mode on the basis of the peak half-value width. However, a plurality of thresholds the number of which is not limited to 2 may be provided so that the optimum print mode can be selected from three or more types.

Now, examples of the treatment liquid and ink for the present embodiment will be described. The treatment liquid for the present embodiment contains a substance that emits light when irradiated with ultraviolet radiation. For example, the treatment liquid can be obtained as follows. The components listed below are mixed and dissolved into a solution, which is then filtered through a membrane filter (product name: Floro Pore Filter manufactured by Sumitomo Electric Industries, Ltd.) of pore size 0.22μ under pressure. The pH of the solution is adjusted to 4.8 in the presence of NaOH to obtain a treatment liquid A1.

[Components of A1]

Cationic compound stearyltrimethyl ammonium salt 2.0 pts brand name: Electro Stripper QE manufactured by KAO CORPORATION) or stearyltrimethyl ammonium chloride (brand name: Utamin 86P manufactured by KAO CORPORATION)

Thiodiglycol 10 pts.

Sodium salicylate salt (ultraviolet fluorescent agent) 5.0 pts.

Water remaining pts.

The following are preferred examples of the ink mixed with the treatment liquid so as to be made insoluble. That is, a yellow ink Y1, a magenta ink N1, a cyan ink C1, and a black ink Bk1 can be obtained by mixing the following components and filtering the obtained solution through a membrane filter of pore size 0.22 μm under pressure.

Y1

C. I. direct yellow 142 2.0 pts.

Thioglycol 10 pts.

Brand name: Acetylenol EH 0.05 pts. (Kawaken Fine Chemicals Co., Ltd.)

Water remaining pts.

M1

The same composition as that of Y1 except for 2.5 pts. of C. I. acid red 289 replacing 2.0 pts. of the dye C. I, direct yellow 142.

C1

The same composition as that of Y1 except for 2.5 pts. of C. I. acid blue 9 replacing 2.0 pts. of the dye C. I, direct yellow 142.

Bk1

The same composition as that of Y1 except for 3 pts. of C. I. food black 2 replacing 2.0 pts. of the dye C. I, direct yellow 142.

In the mixture of the treatment liquid and the ink shown above, the treatment liquid and ink resting on or contained in the print medium 12 are mixed together. As a result, a cationic group of a cationic compound of the cationic substances contained in the treatment liquid is associated with and bonded to the water-soluble dye in the ink, having an anionic group, through an ionic interaction. The bonded groups are instantaneously made insoluble to water.

In the present embodiment, the ink is not limited to the dye type but may be a pigment type in which a pigment is dispersed. The treatment liquid may have function aggregating the pigment. Examples of the pigment ink that is aggregated when mixed with the above treatment liquid A1 are listed below. A yellow ink Y2, a magnet ink M2, a cyan ink C2, and a black ink Bk2 each containing a pigment and an anionic compound can be obtained as described below.

BK2

An anionic polymer P-1 (styrene-methacrylic acid-ethylacrylate, acid value: 400, weight average molecular weight: 6,000, water solution with 20% of solids, neutralizer: potassium hydroxide) was used as a dispersant. The materials listed below were set in a batch-type vertical sand mill (manufactured by IMEX Co., Ltd.), and glass beads of diameter 1 mm were filled into the sand mill as media. The materials were dispersed for 3 hours while being cooled in water. After dispersion, viscosity was 9 cps and pH was 10.0. The fluid dispersion was set in a centrifugal separator to remove coarse particles to produce carbon black dispersions of weight average particle size 100 nm.

(Composition of the Carbon Black Dispersions)

P-1 water solution (20% of solids) 40 pts.

Carbon black 24 pts. (Brand name: Mogul manufactured by Cabot Corporation)

Glycerin 15 pts.

Ethyleneglycolmonobutylether 0.5 pts.

Isopropyl alcohol 3 pts.

Water 135 pts.

Then, the dispersions obtained were sufficiently diffused to obtain an ink jet black ink BK2 containing a pigment. The final preparation contained about 10% of solids.

Y2

An anionic polymer P-2 (styrene-acrylic acid-ethylmethacrylate, acid value: 280, weight average molecular weight: 11,000, water solution with 20% of solids, neutralizer: diethanolamine) was used as a dispersant. The materials listed below were dispersed as was the case with the production of the black ink Bk2 to produce yellow dispersions of weight average particle size 103 nm.

(Composition of the Carbon Black Dispersions)

P-2 water solution (20% of solids) 35 pts.

Carbon black 24 pts. (Brand name: Novaperm Yellow PH-G manufactured by Hoechst Aktiengesellschaft)

Triethylene glycol 10 pts.

Diethylene glycol 10 pts.

Ethyleneglycolmonobutylether 1.0 pts.

Isopropyl alcohol 0.5 pts.

Water 135 pts.

Then, the yellow dispersions obtained were sufficiently diffused to obtain an ink jet yellow ink Y2 containing a pigment. The final preparation contained about 10% of solids.

C2

The anionic polymer P-1 used to produce the black ink Bk2 was used as a dispersant. The materials listed below were dispersed as was the case with the above carbon black dispersions to produce cyan dispersions of weight average particle size 120 nm.

(Composition of the Cyan Dispersions)

P-1 water solution (20% of solids) 30 pts.

C. I. pigment blue 15:3 24 pts. (Brand name: Fastogen Blue FGF manufactured by DAINIPPON INK AND CHEMICALS, INCORPORATED)

Glycerin 15 pts.

Diethyleneglycolmonobutylether 0.5 pts.

Isopropyl alcohol 3.0 pts.

Water 135 pts.

Then, the cyan dispersions obtained were sufficiently diffused to obtain an ink jet cyan ink C2 containing a pigment. The final preparation contained about 9.6% of solids.

Magenta ink M2 The anionic polymer P-1 used to produce the black ink Bk2 was used as a dispersant. The materials listed below were dispersed as was the case with the above carbon black dispersions to produce magenta dispersions of weight average particle size 115 nm.

(Composition of the Magenta Dispersions)

P-1 water solution (20% of solids) 20 pts.

C. I. pigment red 122 24 pts. (manufactured by DAINIPPON INK AND CHEMICALS, INCORPORATED)

Glycerin 15 pts.

Isopropyl alcohol 3.0 pts

Water 135 pts.

Then, the magenta dispersions obtained were sufficiently diffused to obtain an ink jet magenta ink M2 containing a pigment. The final preparation contained about 9.2% of solids.

The present embodiment can efficiently provide the treatment liquid with the function of sensing the ink absorptivity of the print medium and the function of making the ink waterproof.

Second Embodiment

The configuration of an ink jet printing apparatus in accordance with a second embodiment is similar to that in accordance with the first embodiment. Its description is thus omitted.

Figure 8:
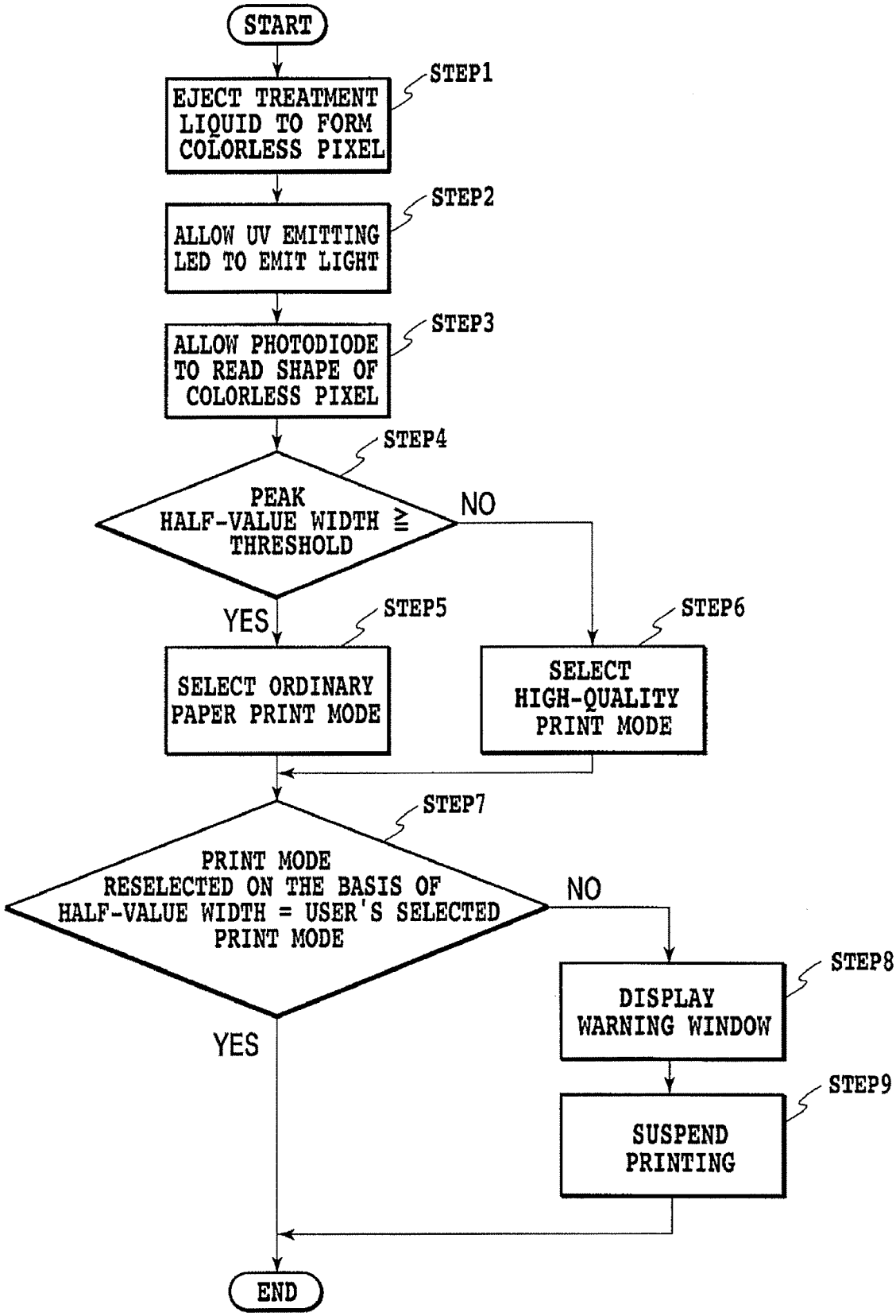
FIG. 8 is a flowchart showing operations of an optimum print mode determining circuit in accordance with a second embodiment of the present invention.

With reference to FIG. 8, description will be given of a method for selecting the print mode in accordance with the present embodiment. FIG. 8 is a flowchart illustrating the UV emitting LED 24 and photodiode 25 as well as the operation of an optimum print mode determining circuit (not shown) that controls the print mode.

Input of a print JOB signal indicating the start of a printing operation allows the optimum print mode determining circuit to start an operation. In step 1, the optimum print mode determining circuit moves the carriage 11 to operate the treatment liquid head 22 so that the treatment liquid is ejected to the vicinity of front end (leading end) of the print medium 12. If the print medium 12 does not completely absorb the treatment liquid, the treatment liquid remains on the print medium 12 to form a dot 26. If the print medium 12 completely absorbs the treatment liquid, all of the treatment liquid permeates the print medium 12. Consequently, the dot 26 is not formed on the print medium 12. The size and shape of the dot 26 varies depending on the ability of the print medium 12 to absorb the treatment liquid.

In step 2, the optimum print mode determining circuit activates the UV emitting LED 24 to irradiate the dot 26 with ultraviolet radiation. The dot 26 emits light and develops a color.

In step 3, the optimum print mode determining circuit uses the photodiode 25 to read the shape of the dot 26. The shape of the read dot 26 is processed as is the case with the first embodiment. Accordingly, the description of this process is omitted.

In step 4, the optimum print mode determining circuit compares a peak half-value width with a prestored threshold. If the half-value width is greater than the threshold, the process proceeds to step 5 to re-select the ordinary paper print mode and then proceeds to step 7. In contrast, if the half-value width is smaller than the threshold, the process proceeds to step 6 to re-select the high-quality print mode and similarly proceeds to step 7.

In step 7, the optimum print mode determining circuit compares the print mode re-selected according to the half-value width with the user's selected print mode. If the print modes match, the optimum print mode determining circuit finishes the process. If the print modes are different, the process proceeds to step 8.

Figure 9:
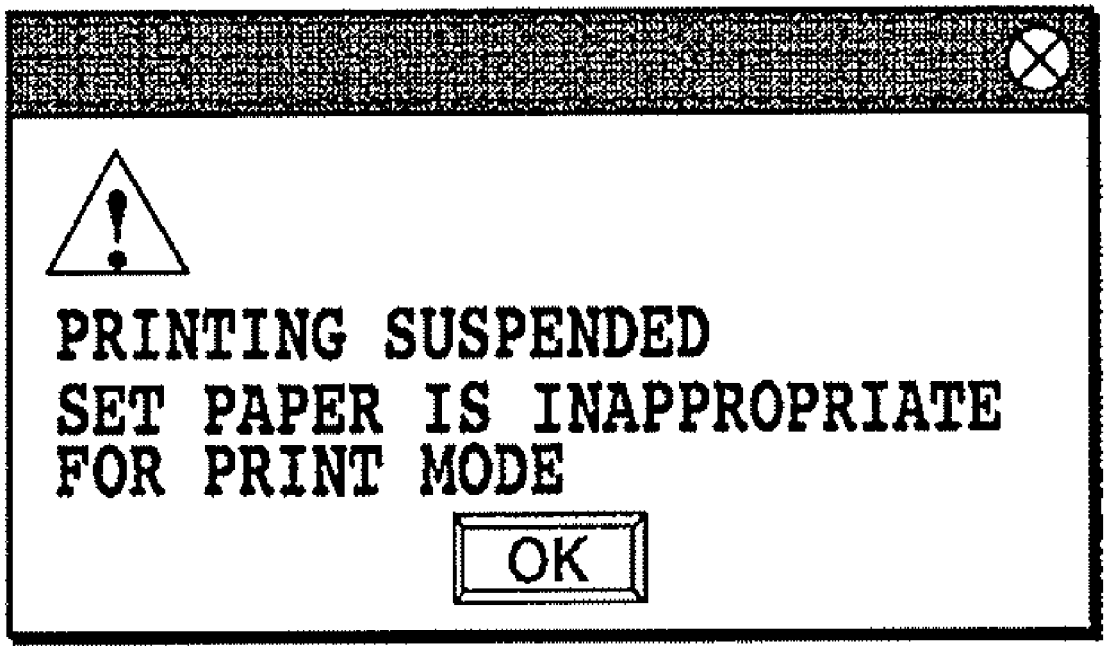
FIG. 9 is a diagram of a warning window displayed on a display screen if a print mode selected by an ink jet printing apparatus does not match a print mode selected by a user in accordance with the second embodiment of the present invention.

In step 8, the optimum print mode determining circuit the warning window shown in FIG. 9 on the display screen (not shown). The process then proceeds to step 9.

In step 9, the optimum print mode determining circuit allows suspending means to suspend the printing process to end the entire process.

In step 7, if the print mode re-selected by the optimum print mode determining circuit matches the user's selected print mode, a print control circuit (not shown) executes printing.

The above process may be executed by the personal computer instead of the printing apparatus.

The treatment liquid and ink for the present embodiment are similar to those in the first embodiment. Accordingly, their description is omitted.

The present embodiment creates a dot 26 on the print medium. The printing apparatus or a device in the personal computer then measures the ink absorptivity of the print medium 12 on the basis of shape of the dot 26 to determine the optimum print mode. If this print mode does not match the user's selected print mode, the process determines that different paper has been fed, and printing process is suspended. This makes it possible to prevent the erroneous selection of the print mode, which may degrade the image quality, without imposing any special burden on the user. The present embodiment can also prevent a print medium different from the expected one from being printed.

Third Embodiment

The configuration of ink jet printing apparatus in accordance with a third embodiment is the same as that in accordance with the first embodiment except that ultraviolet radiation, invisible region light, emitted by the UV emitting LED 24 impinges on and is absorbed by a dot on a print medium precontaining an ultraviolet fluorescent substance as described below. Thus, the description of similar components is omitted.

Figure 10A:
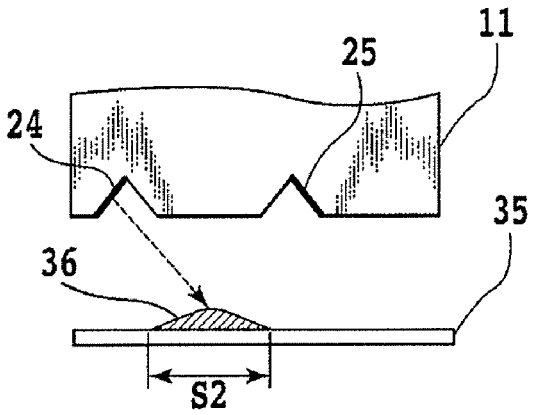
FIGS. 10A and 10B are diagrams illustrating a process of reading dots using reading means provided in a carriage in accordance with the second embodiment.
Figure 10B:
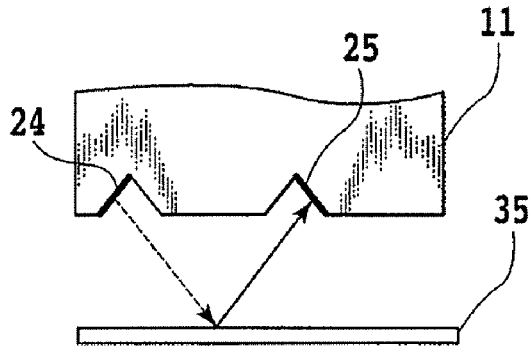

FIGS. 10A and 10B show the configuration of reading means in accordance with the present embodiment.

A treatment liquid for the present embodiment forms a dot 36 shown in FIG. 10A and contains an ultraviolet absorbing substance, a light absorbing substance that absorbs ultraviolet radiation. A print media 35 shown in FIGS. 10A and 10B are ink absorptivity sensing print media precontaining an ultraviolet fluorescent substance, a luminescent substance that emits light when irradiated with ultraviolet radiation. The dot 36 contains the substance that absorbs ultraviolet radiation. Thus, even when the exposed area S2 of the dot 36 on the print medium 35 is irradiated with ultraviolet radiation emitted by the UV emitting LED 24, the optical energy of the ultraviolet ray is converted into thermal energy. This prevents light from being emitted by the area S2.

The ejected treatment liquid impacts the print medium 35 to form a dot 36, which is thus placed on the print medium 35. Here, if the print medium 35 is formed of a material that does not completely absorbs the treatment liquid, the treatment liquid remains on the print medium 35. The dot 36 subsequently remains formed on the print medium 35 as shown in FIG. 10A. If the print medium 35 is formed of a material that completely absorbs the treatment liquid, the treatment liquid completely permeates the print medium 35. Consequently, the dot 36 is not formed on the print medium 35 as shown in FIG. 10B. The higher ink absorptivity of the print medium 35 increases the amount of treatment liquid permeating the print medium 35. This instead reduces the size (area) W2 of the exposed area S2 on the print medium 35. In contrast, the lower ink absorptivity of the print medium 35 increases the size (area) W2 of the exposed area S2 of the dot 36 on the print medium 35. The smaller size W2 of exposed area S2 of the dot 36 on the print medium 35 increases the quantity of ultraviolet radiation emitted by the UV emitting LED 24 and impinging on the print medium 35, while increasing the intensity of light received by the photodiode 25. The larger size W2 of exposed area S2 of the dot 36 on the print medium 35 reduces the quantity of ultraviolet radiation impinging on the print medium 35, while reducing the intensity of light received by the photodiode 25.

Figure 11:
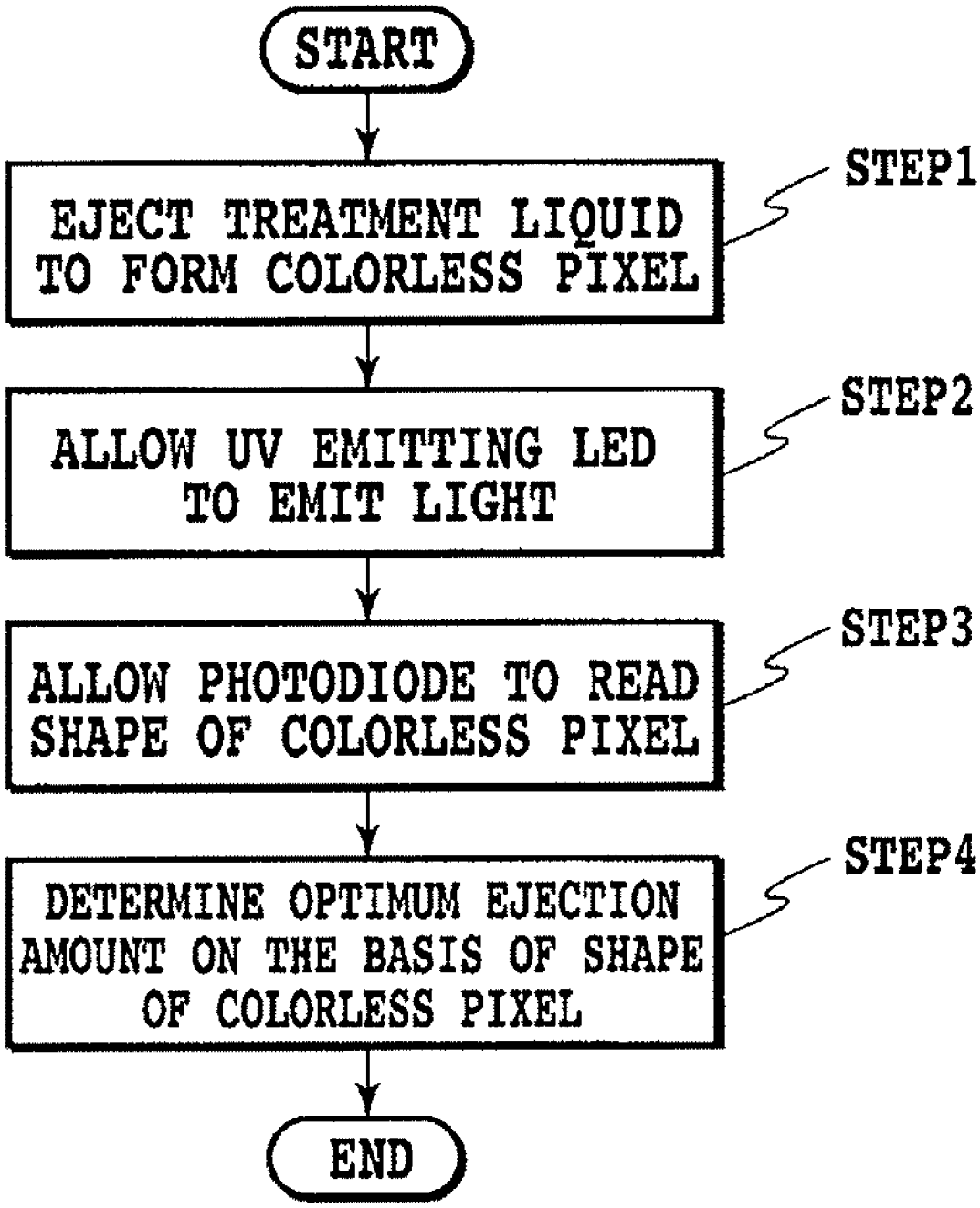
FIG. 11 is a flowchart showing operations of an optimum ejection amount determining circuit for ink in accordance with a third embodiment of the present invention.

Now, with reference to FIG. 11, description will be given of a method for selecting the optimum ink ejection amount in accordance with the present embodiment. FIG. 11 is a flowchart illustrating the UV emitting LED 24 and photodiode 25 as well as the operation of the optimum print mode determining circuit (not shown) that controls the print mode.

Input of a print JOB signal indicating the start of a printing operation allows the optimum print mode determining circuit to start an operation. In step 1, the optimum print mode determining circuit moves the carriage 11 to operate the treatment liquid head 22 so that the treatment liquid is ejected to the vicinity of front end (leading end) of the print medium 35.

In step 2, the optimum print mode determining circuit activates the UV emitting LED 24 to irradiate the dot 36 with ultraviolet radiation to allow the print medium 35, containing the ultraviolet fluorescent substance, to emit light.

In step 3, the optimum print mode determining circuit uses the photodiode 25 to read the shape of the dot 36. The function of the photodiode 25 is the same as that in the first embodiment and its description is thus omitted.

With reference to FIG. 10, description will be given of configuration of the UV emitting LED 24 and the photodiode 25. FIG. 10 is a schematic diagram illustrating the configuration of the UV emitting LED 24 and the photodiode 25. Part of ultraviolet radiation, invisible region light, emitted by the UV emitting LED 24 impinges on the dot 36 on the print medium 35. Since the dot 36 is formed of the ultraviolet absorbing substance, a light absorbing substance that absorbs ultraviolet radiation, part of the ultraviolet radiation which impinges on the dot 36 is absorbed by it. Part of the ultraviolet radiation which does not impinge on the dot 36 induces the fluorescent substance, a luminescent substance, contained in the print medium 35 to emit light. The photodiode 25 then receives the light emitted by the ultraviolet fluorescent substance in the print medium 35 irradiated with ultraviolet radiation.

Figure 12:
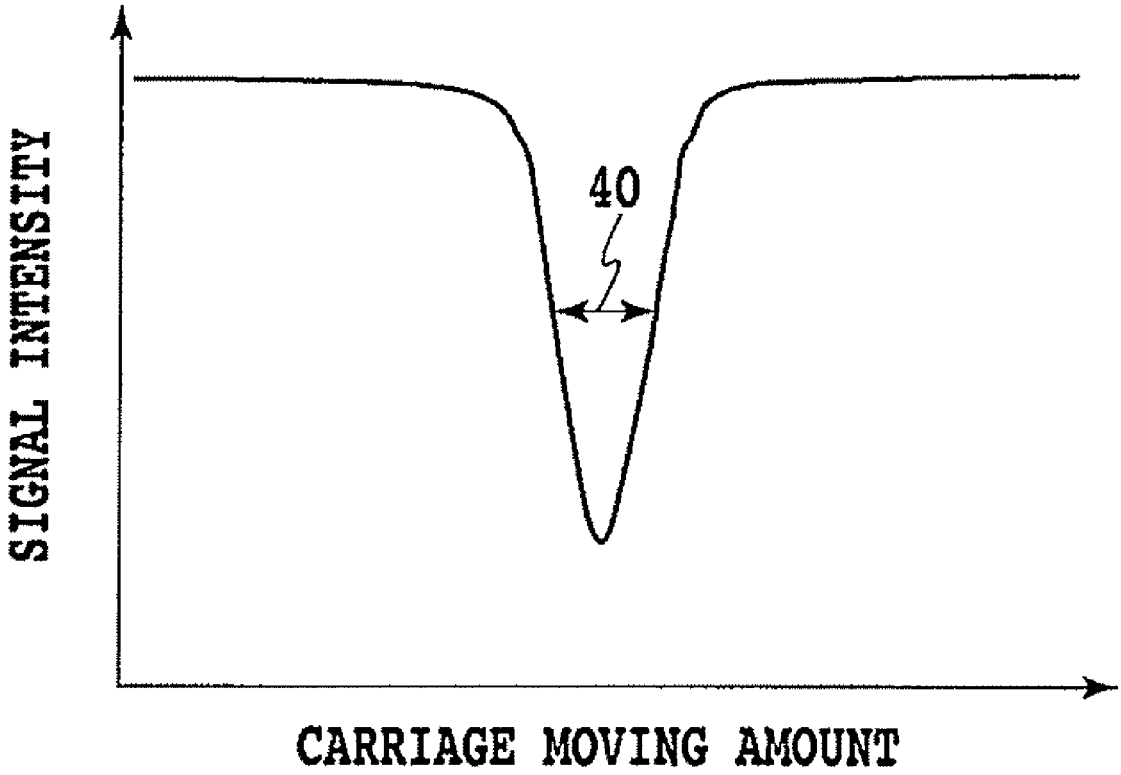
FIG. 12 is a graph of signal data output by a photodiode 25 in accordance with the third embodiment of the present invention.

FIG. 12 is a graph showing the intensity of a signal output by the photodiode 25. Since the present embodiment uses the treatment liquid containing the ultraviolet absorbing substance, the signal output by the photodiode 25 exhibits a waveform protruding downward in the vicinity of the dot 36. The optimum print mode determining circuit calculates the half-value width 40 of peak of the signal intensity on the basis of the quantity of light received by the photodiode 25.

Then, in step 4, on the basis of the half-value width 40 of the peak, the optimum print mode determining circuit, having ink ejection amount determining means, determines the optimum ink ejection amount corresponding to the half-value width 40 with reference to a table, and finish the process. The table prestores thresholds for a plurality of half-value widths 40 corresponding to plural types of print medium and the optimum ejection amounts corresponding to the values of the half-value widths 40 not exceeding the respective thresholds.

Then, the print control circuit (not shown) executes Printing with the optimum ink ejection amount. The inkejection amount is adjusted on the basis of, for example, the duty ratio or the number of injections into a unit pixel.

The above process may be executed by the personal computer instead of the printing apparatus.

Examples of the treatment liquid for the present embodiment will be described. The treatment liquid for the present embodiment which makes the ink dye insoluble contains the ultraviolet absorbing substance, which absorbs ultraviolet radiation. For example, the treatment liquid can be obtained as follows. The components listed below are mixed and dissolved into a solution, which is then filtered through a membrane filter (product name: Floro Pore Filter manufactured by Sumitomo Electric Industries, Ltd.) of pore size 0.22 μm under pressure. The pH of the solution it adjusted to 4.8 in the presence of NaOH to obtain a treatment liquid Al.

[Components of A2]

Cationic compound stearyltrimethyl ammonium salt 2.0 pts (brand name: Electro Stripper QE manufactured by KAO CORPORATION) or stearyltrimethyl ammonium chloride (brand name: Utamin 86P manufactured by KAO CORPORATION)

Thiodiglycol 10 pts.

TINUVIN 400 (ultraviolet absorbing agent; brand name; manufactured by Nihon Chiba-Geigv KK.) 3.0 pts.

Water remaining pts.

Examples of the ink for the present embodiment are similar to those in the first embodiment and their description is thus omitted.

The present embodiment creates a dot 36 on the print medium 35. The ink absorptivity of the print medium 35 is measured on the basis of size W2 of the exposed area S2 of the dot 36 on the print medium 35. The optimum ink ejection amount is then determined on the basis of the measured absorptivity. Printing is thus executed with the optimum ink ejection amount. This makes it possible to prevent the erroneous selection of the print mode, which may degrade the image quality, without imposing any special burden on the user. The ink ejection amount can also be adjusted so as to deal with bleeding.

Other Embodiments

In the above embodiments, the ink jet printing apparatus uses the inks in the four colors, black, cyan, magenta, and yellow. However, the ink colors are not limited to this combination. For example, pale magenta and pale cyan or other colors may be added to these four colors.

Further, in the above embodiments, the dot allowed to emit light by ultraviolet irradiation or allowed to absorb the applied ultraviolet radiation is composed of the treatment liquid prepared separately from the color inks. However, any of the color inks may be used as the dot. When any color ink is used to form a dot, it needs to precontain a luminescent substance that emits light when irradiated with invisible region light such as ultraviolet radiation or a light absorbing substance that absorbs light. In this case, the color ink used as a dot is preferably in a pale color. For example, with an ink jet printing apparatus using four colors, black, cyan, magenta, and yellow, the pale color ink for measurement of the ink absorptivity is desirably in yellow. With an ink jet printing apparatus using six colors, that is, the four colors including black, cyan, magenta, and yellow plus pale magenta and pale cyan, the treatment liquid is desirably in pale magenta or pale cyan. Either of these pale color inks is ejected onto the print medium before the formation of image data so that the reading means can recognize its shape before the formation of image data.

Alternatively, printing inks and a colorless ink may be prepared so that the colorless ink can be used to form a dot. Alternatively, different treatment liquids may be used to form a dot for the determination of the print mode or ink ejection amount and to make the ink insoluble to water, respectively.

When a pale color ink is used to measure the ink asborptivity, since the ink is colored, though in the pale color, it is ejected to a position where the resulting ink dot is unnoticeable when image data is embodied. This prevents the quality of a printed image from being degraded. The position where the ink dot is unnoticeable is the position of the print medium at which a part of the image having a high optical density is formed, the vicinity of a part of the image having a high optical density, or the periphery of the print medium, where no image is printed. One of these positions is selected for ink ejection according to the image data. However, in view of printing quality, for an ink jet printing apparatus comprising means for ejecting the treatment liquid in addition to the printing ink in order to improve waterproof, the treatment liquid for measurement of the ink absorptivity desirably contains no color material.

In the above embodiments, the UV emitting LED is used as the light emitting means of the reading means. However, a photoelectric tube may be used as the light emitting means. Further, the photodiode is used as the light receiving means. However, a CCD may be used as the light receiving means.

To make the printing ink insoluble to water, the treatment liquid is composed of a material containing a hydroxide salt or polymer salt of metal as a component that reacts with the dye or pigment in the printing ink to make it insoluble to water. Specific examples of the polymermetal salt include a stearyltrimethyl ammonium salt and a copolymer of diarylamine hydrochloride and sulfur dioxide. When the treatment liquid is ejected before or after the ejection of the printing ink, these metal salts react with and bind to the color material in the printing ink such as an aqueous dye or pigment dispersions on the print medium or at the position where they permeate the print medium. This makes the printing ink insoluble to water.

The process for the first and second embodiments contain a substance that emits light when irradiated with ultraviolet radiation or that absorbs the applied ultraviolet radiation. The substance reacting with ultraviolet radiation or the like to emit light exhibits a fluorescent or phosphorous phenomenon when irradiated with light with the wavelength of the ultraviolet region (10 to 450 nm) to emit light with the wavelength of the visible light region (380 to 780 nm). Specific examples of such a substance include sodium salicylate, sodium benzoate, and a tetra [4,4,4-trifluoro-1-(2-furanyl)-1,3-butanedionate]europium complex. Other examples include a tetra [4,4,4-trifluoro-1-phenyl-1,3-butanedionate]europium complex and a tetra [4,4,4-trifluoro-1-(2-thionyl)-1,3-butanedionate]europium complex. Other examples include a tetra [4,4,4-trifluoro-1-naphthyl-1,3-butanedionate]europium complex and a tetra [4,4,4-trifluoro-1-methyl-1,3-butanedionate]europium complex.

The ultraviolet absorbing substance for the third embodiment absorbs light with the wavelength of the ultraviolet region (300 to 450 nm) to emit it in the form of thermal energy. Specifically, it is possible to use any well-known substance containing salicylate, benzophenone, benzotirazole, acrylonitrile, hindered amine, metal complex salt, or the like. Specific preferred examples include phenylsalicylate, p-t-butylphenylsalicylate, p-octylsalicylate, and 2-hydroxybenzophenone. Other examples include 2,4-dihydroxybenzophenone, 2-hydroxy-4-methoxybenzophenone, 2-hydroxy-4-methoxy-2'-carboxybenzophenone, and 2-hydroxy-4-methoxy-5-sulfobenzophenone trihydrate. Other examples include 2-hydroxy-4-octoxybenxophenoene, 2-hydroxy-4-octadecyloxybenzophenone, 2-hydroxy-4-methoxybeonzophenone-5-sulforic acid, and 2-hydroxy-4-dodecyloxybenzophenone. Other examples include 2,2'-dihydroxy-4-methoxybezophenone, 2,2'-dihydroxy-4,4'-dimethoxybenzophenone, and 2,2',4'4-tetrahydroxybenzophenone. Other examples include sodium-2,2'-dihydroxy-4,4'-dimethoxy-5-sulfobenzophenone, 5-chlor-2-hydrocybenzophenone, and 2-(2'-hydroxy-4'-octoxyphenyl) benzotriazole. Other examples include 2-(2'-hydroxy-3'-t-butyl-5'-methylphenyl)-5-chlorbenzotriaz ole, and 2-(2'-hydroxy-3'-t-butyl-5'-octylphenyl propionate-5-chlorbenzotriazole. Other examples include 5'-octylphenyl propionate-5-chlorbenzotriazole, 2-(2'-hydroxy-5'-methylphenyl)benzotriazole, and 2-(2'-hydroxy-5'-t-butylphenyl) benzotriazole. Other examples include 2-(2'-hydroxy-3',5-di-t-butylphenyl)benzotrizole, 2-(2'-hydroxy-3',5-di-t-butylphenyl)-5-chlorbenzotrizole, and 2-(2'-hydroxy-3',5-di-t-amylphenyl). Other examples include 2-[2-hydroxy-3,5-di(2,2-dimethylbenzine)-phenyl]-2H-benzotrizole, 2-ethylhexyl-2-cyano-3,3'-diphenylacrylate, and ethyl-2-cyano-3,3-diphenylacrylate. Another example is nickelbis(octylphenyl) sulfide. Other examples include [2,2'-thiobis(4-t-octylphenolate)]-n-butylaminenickel and 3-[3-(2H-benzotriazole)-2-yl-5-t-butyl-4-hydroxyphenyl]propionic mono and diesters of polyethylene glycol. Other examples include nickel complex-3,5-di-t-butyl-4-hydroxybenzyl-monoethylate phosphate, nickeldibutyldiocarbamate, rezorcinol monobenzoate, and hexamethyl phosphoryl triamide. Other examples include 2,4,5-trihydroxybutylphenone, di-p-octylphenylterephthalate, and di-p-n-norylpnhenylisophthalate. Other examples include hindered amines such as 2-(3,5-di-t-butyl-4-hydroxybenzyl)-2-n-butyl malonic acid and bis(1,2,2,6-pentamethyl-4-piperidine), and substances introduced into copolymers together with other monomers. These substances include 2-oxy-4-(2-oxy-3-methachryloxy)propoxybenzophenone and diphenylmethylenecyan ethyl acetate.

In the above embodiments, for the timing for the ejection of the treatment liquid, the print mode or ink ejection amount is determined through one operation of ejecting the treatment liquid per print medium. However, provided that a plurality of print media of the same type are used for printing, the print mode or ink ejection amount may be determined only with the first print medium rather than with every print medium. Printing may subsequently be executed using the same setting. Alternatively, before starting printing with the printing inks, a print media of the same type may be prepared for the determination of the print mode or ink ejection amount. Then, the subsequent print media may be printed using the same print mode or ink ejection amount. This makes it possible to prevent the treatment liquid used to determine the print mode or ink ejection amount from affecting the quality of a printed image. This procedure is particularly effective if a colored ink is used as the treatment liquid.

According to the above embodiments, the ink and treatment liquid are mixed together on the print medium to make the ink insoluble to water. Accordingly, the treatment liquid is ejected every time the ink is ejected. The print mode or ink ejection amount may thus be determined every time the printing ink is ejected. Consequently, even with a variation in material characteristics on a single print medium, printing can be executed with the optimum ink ejection amount for the characteristics of a particular print area. The ability to always execute printing with the optimum ink ejection amount allows the ink jet printing apparatus to provide higher-quality printed images.

In the above embodiments, the treatment liquid emitting light when irradiated with ultraviolet radiation is used to determine the ink absorptivity and thus print mode of the print medium. The treatment liquid absorbing ultraviolet radiation is then used to determine the optimum ink ejection amount. However, the treatment liquid emitting light when irradiated with ultraviolet radiation may be used to determine the optimum ink ejection amount of the print medium. The treatment liquid absorbing ultraviolet radiation may be used to determine the print mode of the print medium.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-059977, filed Mar. 6, 2006, which is hereby incorporated by reference herein in its entirety.

What is claimed is:

1. An ink jet printing apparatus provided with an ink jet print head that ejects printing ink to a print medium for performing printing, the apparatus setting a plurality of print modes for plural types of print media, said apparatus comprising:

dot forming means for forming a dot by applying a liquid droplet to the print medium;

reading means for reading the dot formed according to an ability of the print medium to absorb the printing ink; and print mode setting means for setting a print mode according to a signal read by said reading means, wherein said print mode setting means sets the print mode on the basis of a half-value width of a peak of a signal intensity read by said reading means.

2. The ink jet printing apparatus according to claim 1, wherein the liquid droplet is formed of a treatment liquid different from the printing ink.

3. The ink jet printing apparatus according to claim 2, wherein the treatment liquid is mixed with the printing ink to make the printing ink insoluble to water.

4. The ink jet printing apparatus according to claim 1, wherein the liquid droplet is formed of the printing ink.

5. The ink jet printing apparatus according to claim 1, wherein said reading means comprises light emitting means for irradiating the dot with light and light receiving means for receiving light emitted by the dot on which the light emitted by said light emitting means impinges.

6. The ink jet printing apparatus according to claim 5, wherein when irradiated with invisible region light, the dot emits light that can be sensed by said light receiving means.

7. The ink jet printing apparatus according to claim 6, wherein the liquid droplet contains a luminescent substance that emits light when irradiated with the invisible region light.

8. The ink jet printing apparatus according to claim 6, wherein the invisible region light is ultraviolet radiation.

9. The ink jet printing apparatus according to claim 5, wherein the print medium is an ink absorptivity sensing print medium that emits light when irradiated with light, and the liquid droplet contains a light absorbing substance that absorbs applied light.

10. The ink jet printing apparatus according to claim 9, wherein when irradiated with invisible region light, the ink absorptivity sensing print medium emits light that can be sensed by said light receiving means.

11. The ink jet printing apparatus according to claim 10, wherein the ink absorptivity sensing print medium contains a luminescent substance that emits light when irradiated with the invisible region light.

12. The ink jet printing apparatus according to claim 9, wherein the light absorbing substance is an ultraviolet light absorbing substance.

13. The ink jet printing apparatus according to claim 1, further comprising suspending means for suspending printing executed by said ink jet printing apparatus if a print mode set by said print mode setting means does not match a print mode selected by a user.

14. An ink jet printing apparatus having an ink jet print head that ejects printing ink to a print medium for printing, the apparatus comprising:

dot forming means for forming a dot by applying a liquid droplet to the print medium;

reading means for reading the dot formed on the basis of an ability of the print medium to absorb the printing ink; and ink ejection amount determining means for determining an ink ejection amount of the printing ink, the ink ejection amount being suitable for the print medium on the basis of a signal read by said reading means, wherein said ink ejection amount determining means determines the ink ejection amount on the basis of a half-value width of a peak of a signal intensity read by said reading means.

15. A method for determining a type of print medium in an ink jet printing apparatus that ejects printing ink to the print medium, the method comprising:

a dot forming step of forming a dot by applying a liquid droplet to the print medium;

a dot reading step of reading the dot formed on the basis of an ability of the print medium to absorb the printing ink; and a print medium determining step of determining the type of print medium on the basis of a signal read in said dot reading step, wherein said print medium determining step determines the type of print media on the basis of a half-value width of a peak of a signal intensity read in said dot reading step.

16. A method for determining an ink ejection amount of an ink jet printing apparatus that ejects printing ink to a print medium, the method comprising:

a dot forming step of forming a dot by applying a liquid droplet to the print medium;

a dot reading step of reading the dot formed on the basis of an ability of the print medium to absorb the printing ink; and an ink ejection amount determining step of determining an ink ejection amount of the printing ink, the ink ejection amount being suitable for the print medium on the basis of the dot read in said dot reading step, wherein said ink ejection amount determining step determines the ink ejection amount on the basis of a half-value width of a peak of a signal intensity read in said dot reading step.

17. An ink jet printing apparatus using a print head that ejects a liquid to form an image on a print medium, the apparatus comprising:

ejecting means for ejecting the liquid to the print medium;

irradiating means for irradiating the liquid ejected by said ejecting means with invisible region light;

light receiving means for receiving light corresponding to applied light reflected by the liquid or light emitted by the liquid in response to the applied light; and setting means for setting a print mode for formation of an image on the print medium on the basis of the quantity of light received by said light receiving means, wherein said setting means sets the print mode on the basis of a half-value width of a peak of a signal intensity of the light received by said light receiving means.

18. The ink jet printing apparatus according to 17, wherein said setting means sets the print mode according to an ability of the print medium to absorb the liquid, which ability can be determined on the basis of the quantity of light received.

* * * * *